US006770832B2

(12) United States Patent
Marchand et al.

(10) Patent No.: US 6,770,832 B2
(45) Date of Patent: Aug. 3, 2004

(54) VACUUM ELECTRICAL INTERRUPTER WITH PULL-TO-CLOSE MECHANISM

(75) Inventors: Francois J. Marchand, Pittsburgh, PA (US); James J. Benke, Pittsburgh, PA (US); Glenn A. Calhoon, Monaca, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/325,303

(22) Filed: Dec. 19, 2002

(65) Prior Publication Data

US 2004/0118815 A1 Jun. 24, 2004

(51) Int. Cl.[7] ..... H01H 33/42
(52) U.S. Cl. ..... 218/140; 218/154
(58) Field of Search ..... 218/118, 140, 218/153, 154, 7, 14, 78, 84, 120, 92; 335/164, 165, 191, 192; 200/400–401

(56) References Cited

U.S. PATENT DOCUMENTS 4,064,383 A * 12/1977 Barkan ..... 218/120
4,654,494 A * 3/1987 Wuthrich ..... 218/140
4,743,876 A * 5/1988 Milianowicz et al. ..... 335/20
4,935,712 A 6/1990 Oyama et al.
5,422,450 A * 6/1995 Miyazawa et al. ..... 218/140
5,436,414 A * 7/1995 Hodkin et al. ..... 218/84
6,002,560 A 12/1999 Nguyen et al.
6,150,625 A 11/2000 Marchand et al.
6,255,615 B1 * 7/2001 Kimblin ..... 218/155
6,495,786 B1 * 12/2002 Tsuji et al. ..... 218/118

* cited by examiner

*Primary Examiner*—Elvin Enad
*Assistant Examiner*—Marina Fishman
(74) *Attorney, Agent, or Firm*—Martin J. Moran

(57) ABSTRACT

An improved electrical interrupter apparatus includes a stationary contact and a movable contact within an enclosed region, with the movable contact being operatively connected with a drive unit that employs a pull-to-close mechanism to engage the movable contact with the stationary contact. When the contacts are desired to be closed, the drive unit applies a tensile force to an elongated rod that extends between the drive unit and a crank mechanism, which converts the tensile force in the rod into a compressive force applied to the movable contact.

14 Claims, 6 Drawing Sheets

VACUUM ELECTRICAL INTERRUPTER WITH PULL-TO-CLOSE MECHANISM

BACKGROUND OF THE INVENTION

1. Field of the Invention

The present invention relates generally to electrical power distribution equipment and, more particularly, to a vacuum interrupter for a power distribution system.

2. Description of the Related Art

Circuit breakers and other power distribution equipment are well known in the relevant art. Circuit breakers are typically configured to interrupt current upon the occurrence of one or more predetermined conditions. Each pole of a circuit breaker typically includes a pair of contacts that are separable from one another in order to interrupt current flowing therethrough.

It is known, however, that electricity can have a tendency to arc between separated contacts. In the event that such an arc occurs, power still continues to flow through the pole with the arc, which is an undesirable situation that is preferably avoided. Additionally, electricity arcing between separated contacts has a tendency to vaporize portions of the contacts, with the result that the contacts are unable to make good electrical connections with one other thereafter. It is thus known to provide vacuum interrupters in certain applications to resist the formation of arcs between separated contacts. Such vacuum interrupters typically include a stationary contact and a movable contact within an evacuated region of a container, whereby the substantial absence of air within the evacuated region resists the formation of arcs between the contacts during separation and during closure thereof. It is also known to provide similar interrupters which include a dielectric gas such as sulfur hexafluoride within a container in the vicinity of the contacts instead of employing an evacuated region in the container.

As is also known in the relevant art, a substantial engagement force must be maintained on the movable contact to keep the contacts engaged with one another when power is being transmitted therethrough. Known interrupters of the type described above thus have included a drive mechanism that can apply a large compressive force to the movable contact and that can pull the contacts apart under appropriate circumstances. In order to isolate the drive mechanism from the high voltage circuit that includes the movable contact, the drive mechanism typically is spaced from the container and is operatively connected with the movable contact by an elongated non-conductive rod. For instance, in particularly high voltage applications, the electrified portions of the container may be spaced twenty-two inches from a base that carries the drive mechanism. Since the compressive force required to retain the movable contact against the stationary contact is transmitted from the drive unit to the movable contact through the elongated rod, the rod often has a tendency to bow a significant amount.

Such bowing of the rod is undesirable for a number of reasons. For instance, it is often desired that the movable contact be moved a fixed distance away from the stationary contact when the contacts are separated. Bowing of the rod results in substantial imprecision in the specific position of the movable contact. Such bowing can also breach an expandable seal that seals the space between the container and the rod. Moreover, a large bow in the rod will have a tendency to delay slightly the separation of the movable contact from the fixed contact since the bow in the rod creates a type of slack that must be taken up before the contacts can be separated. Furthermore, the rod moves at a speed in the range of about 1.5 to 2 meters per second during separation and closing. The speed with which the rod bows at the time the contacts are closed causes the rod to elastically flap about, which delays the creation of a solid connection between the contacts and/or results in excessive contact bounce.

It is thus desired to provide an improved electrical interrupter apparatus that overcomes the problems associated with known push-to-close interrupters.

SUMMARY OF THE INVENTION

The present invention successfully meets and exceeds these and other needs. An improved electrical interrupter apparatus includes a stationary contact and a movable contact within an enclosed region, with the movable contact being operatively connected with a drive unit that employs a pull-to-close mechanism to engage the movable contact with the stationary contact. When the contacts are desired to be closed, the drive unit applies a tensile force to an elongated rod that extends between the drive unit and a crank mechanism, which converts the tensile force in the rod into a compressive force applied to the movable contact.

An aspect of the present invention is to provide an improved electrical interrupter apparatus that applies a tensile force to an elongated rod in order to close a pair of electrical contacts.

Another aspect of the present invention is to provide an improved electrical interrupter apparatus that includes a crank which can transform a tensile force into a compressive force applied to a movable contact.

Another aspect of the present invention is to provide an improved electrical interrupter apparatus that employs a pair of contacts in a vacuum region and that is capable of moving one of the contacts substantially precise distances.

Another aspect of the present invention is to provide an improved electrical interrupter apparatus that employs rods or links that are substantially free of bowing when a compressive force is applied to a movable contact.

Another aspect of the present invention is to provide an improved electrical interrupter apparatus that reliably and rapidly opens and closes a set of contacts within a vacuum vacuum bottle.

These and other aspects of the present invention are provided by an electrical interrupter apparatus, the general nature of which can be stated as including an interruption device including an interior and having an enclosed region within at least a portion of the interior, a stationary contact disposed within the enclosed region, and a movable contact disposed within the enclosed region. The movable contact is movable between a closed position and an open position, and the movable contact is engaged with the stationary contact in the closed position. The movable contact is spaced from the stationary contact in the open position. The electrical interrupter apparatus further includes a first link operatively connected with the movable contact, a second link, a crank operatively interposed between the first and second links, and a driving system including a drive unit. The drive unit is operatively connected with the second link and is structured to rapidly separate the movable and stationary contacts. One of the first and second links is longer than the other of the first and second links, and the one of the first and second links is in a state of tension when the movable contact is in the closed position.

The driving system may additionally include a return spring that biases the movable contact to the open position.

Alternatively, or in addition thereto, the interruption device may include a support, with the crank being pivotably mounted to the support. The enclosed region may be a region of reduced pressure.

Another aspect of the present invention is to provide an electrical interrupter apparatus, the general nature of which can be stated as including an interruption device including an interior and having an enclosed region within at least a portion of the interior, a stationary contact disposed within the enclosed region, and a movable contact disposed within the enclosed region. The movable contact is movable between a closed position and an open position, the movable contact is engaged with the stationary contact in the closed position, and the movable contact is spaced from the stationary contact in the open position. The electrical interrupter apparatus further includes a first link operatively connected with the movable contact, a second link, a crank pivotably mounted to the interruption device, the first and second links each being pivotably mounted to the crank, and a driving system including a drive unit. The drive unit is operatively connected with the second link and is structured to rapidly separate the movable and stationary contacts, and the second link is in a state of tension when the movable contact is in the closed position.

The driving system may additionally include a return spring that biases the movable contact to the open position. Alternatively, or in addition thereto, the interruption device may include a vacuum vacuum bottle and a support, the vacuum vacuum bottle being mounted to the support, the enclosed region being disposed within the vacuum vacuum bottle, and the crank being pivotably mounted to the support.

Another aspect of the present invention is to provide an electrical interrupter apparatus, the general nature of which can be stated as including an interruption device including an interior and having an enclosed region within at least a portion of the interior, a stationary contact disposed within the enclosed region, and a movable contact disposed within the enclosed region. The movable contact is movable between a closed position and an open position, with the movable contact being engaged with the stationary contact in the closed position, and with the movable contact being spaced from the stationary contact in the open position. The electrical interrupter apparatus also includes a first link operatively connected with the movable contact, a second link, a crank operatively interposed between the first and second links, and a driving system including a drive unit. The drive unit is operatively connected with the second link and is structured to rapidly separate the movable and stationary contacts. The first link is in a state of compression when the movable contact is in the closed position, and the second link is in a state of tension when the movable contact is in the closed position. The first and second links are oriented generally parallel with one another.

The first and second links may be mounted on the crank and extend in generally opposite directions away from the crank. The interruption device may include a vacuum vacuum bottle and a support, with the vacuum vacuum bottle being mounted to the support, with the enclosed region being disposed within the vacuum bottle, and with the crank being pivotable mounted to the support. The crank may be pivotable about an axis that is oriented substantially perpendicular to the orientation of the first and second links. The support may include a pair of parallel and spaced apart fins, with the crank including a pair of crank plates, with the crank plates being pivotably mounted to the fins whereby the fins straddle the crank plates, and with each crank plate including a pair of elongated slots spaced apart from one another in generally opposite directions from the axis about which the crank plate rotates, the elongated slots being oriented generally parallel with one another.

BRIEF DESCRIPTION OF THE DRAWINGS

A further understanding of the invention can be gained from the following Description of the Preferred Embodiment when read in conjunction with the accompanying drawings in which.

Similar numerals refer to similar parts throughout the specification.

DESCRIPTION OF THE PREFERRED EMBODIMENT

Figure 1:
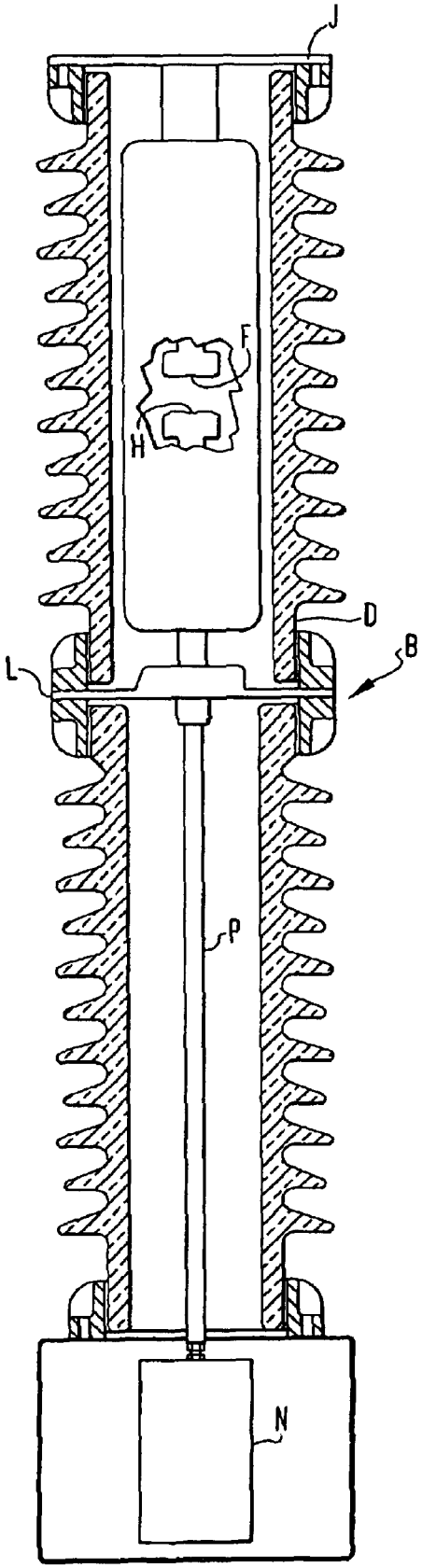
FIG.1 PRIOR ART
FIG. 1 is a front elevational view partially cut away, of a prior art vacuum interrupter having a pair of contacts in an open condition.
Figure 2:
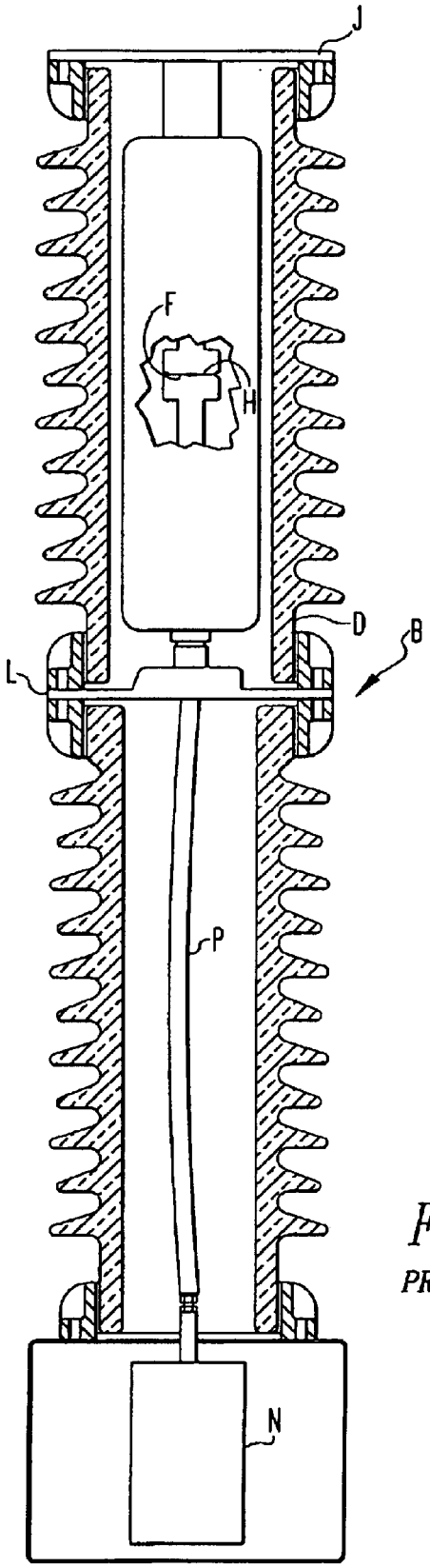
FIG. 2 PRIOR ART
FIG. 2 is a view similar to FIG. 1 except depicting the contacts in a closed condition.
Figure 3:
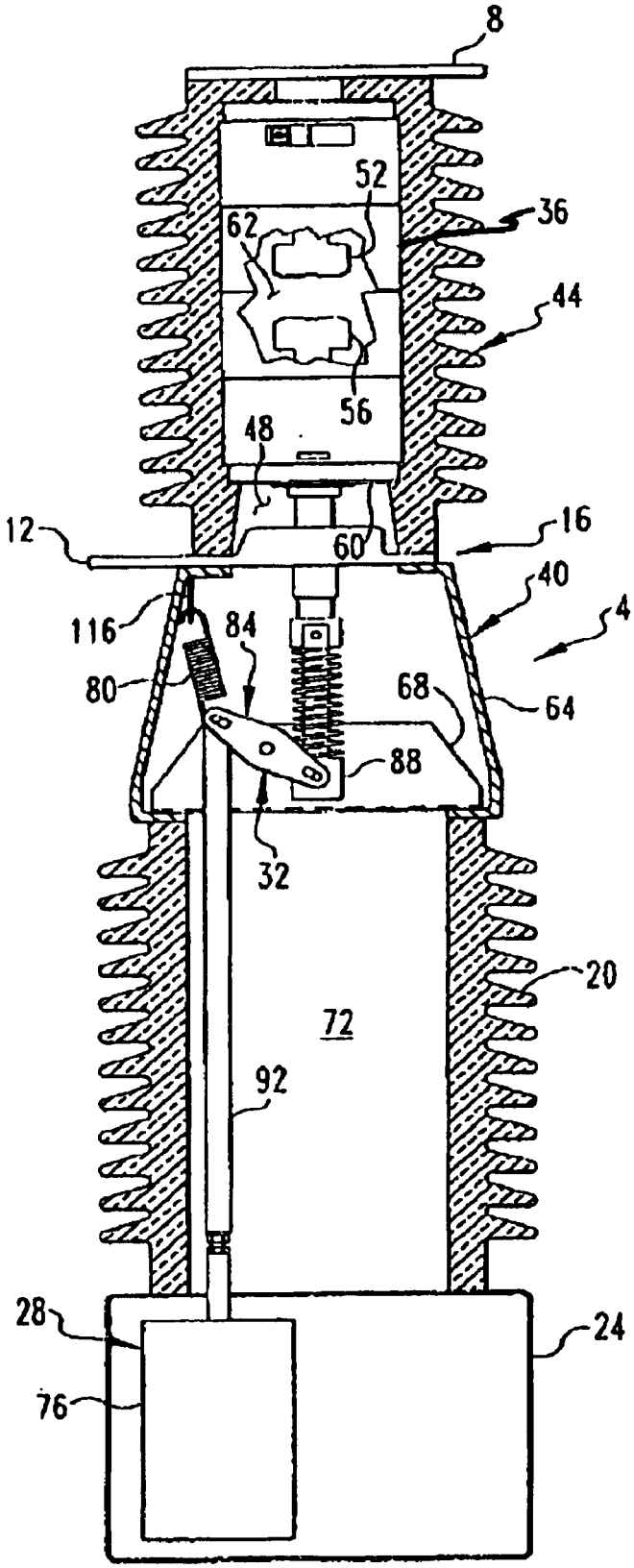
FIG. 3 is a front elevational view, partially cut away, of an improved electrical interrupter apparatus in accordance with the present invention and including a set of contacts in an open condition.

A known electrical interrupter B is depicted generally in FIGS. 1 and 2. The electrical interrupter B particularly includes a container D having an enclosed region within the interior thereof. The exemplary enclosed region contains sulfur hexafluoride gas at a pressure of about 100 psi. The container D additionally includes a stationary contact F and a movable contact H disposed within the enclosed region thereof. The container D additionally includes a line connector J and a load connector L mounted thereon. The line connector J can be connected with a power source, and the load connector L can be connected with a load, all in a known fashion.

The electrical interrupter B also includes a driver N and a connecting rod P, with the connecting rod P operatively extending between the driver N and the movable contact H. The driver N and the connecting rod P are employed to move the movable contact H between an open position (FIG. 1) and a closed position (FIG. 2).

It can be seen that the driver N applies a compressive force to the connecting rod P to move the movable contact H to the closed position and to retain the movable contact H engaged with the stationary contact F with sufficient force to maintain a desirable electrical connection between the stationary and movable contacts F and H when current passes between the line and load connectors J and L. As can be seen in FIG. 2, however, the connecting rod P is undesirably severely bowed when the movable contact H is in the closed position due to the large compressive load carried by the connecting rod P as well as the length of the connecting rod P.

An improved electrical interrupter apparatus 4 in accordance with the present invention that overcomes such problems and others is indicated generally in FIGS. 3–6. The electrical interrupter apparatus 4 includes a line connector 8 and a load connector 12 that are connectable with a power source and with a load, respectively, in a known fashion. The electrical interrupter apparatus 4 is a vacuum interrupter that is advantageously suited to high voltage applications and is capable of selectively maintaining and eliminating electrical continuity between the line and load connectors 8 and 12 to desirably provide power to the load or to maintain an open circuit.

The electrical interrupter apparatus 4 can be generally stated as including an interruption device 16, an insulation member 20, a base 24, a driving system 28, and a linkage mechanism 32. A plurality of the electrical interrupter apparatuses 4 may be incorporated into a circuit breaker (not shown) such as a 72.5 kV outdoor circuit breaker or other circuit breaker.

The interruption device 16 can be generally stated as including a vacuum vacuum bottle 36 and a support 40 attached together. The vacuum vacuum bottle 36 includes the line connector 8 and the load connector 12 at opposite ends thereof. The vacuum vacuum bottle 36 additionally includes a container 44 generally interposed between the line and the load connectors 8 and 12. The container 44 is formed with an interior 48, with a stationary contact 52 and a movable contact 56 being disposed within the interior 48, and with an expandable seal 60 being mounted on the container 44 at the mouth of the interior 48. The interior 48 includes an enclosed region 62 defined generally by the expandable seal 60. In the exemplary embodiment described herein, the enclosed region 62 includes a region of reduced pressure, i.e., a vacuum, therein, and the expandable seal 60 at the mouth of the interior 48 maintains the vacuum.

Figure 4:
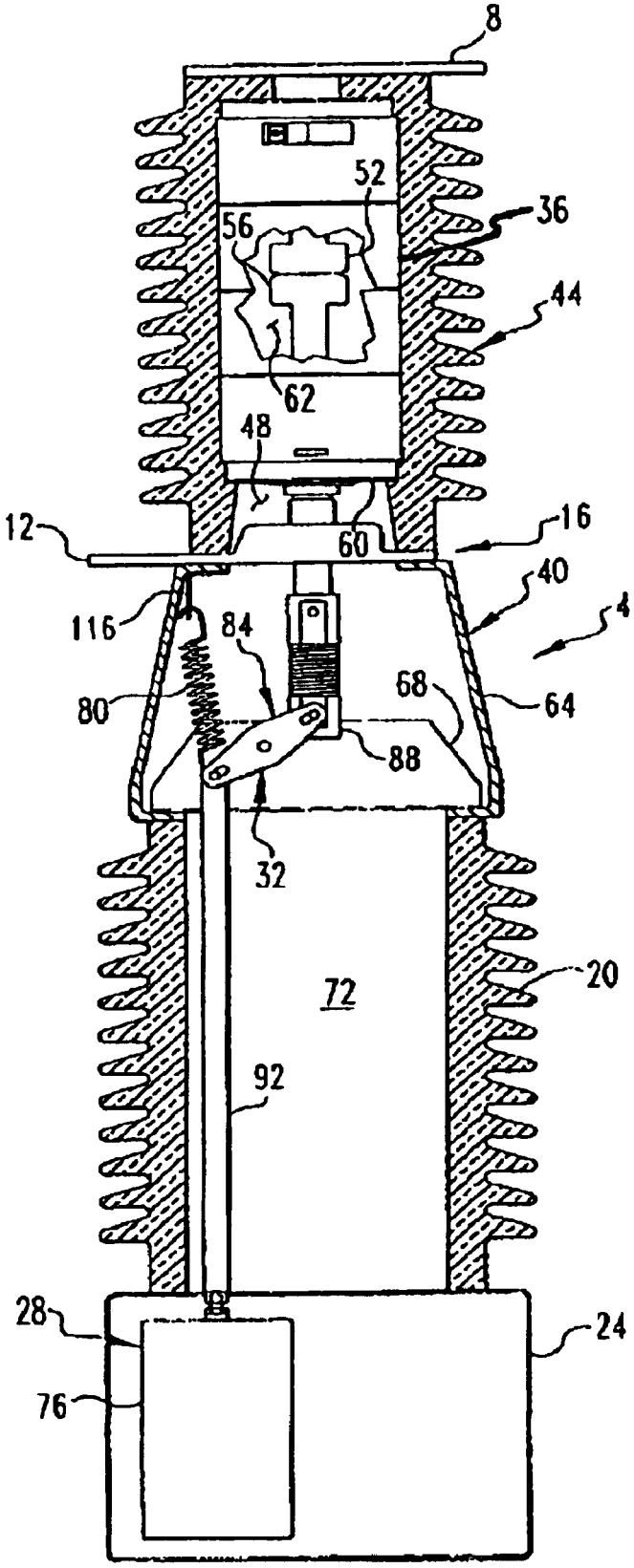
FIG. 4 is similar to FIG. 3, except depicting the set of contacts in a closed condition.

The stationary contact 52 is fixedly mounted within the enclosed region 62 and is electrically conductively connected with the line connector 8. The movable contact 56 is electrically conductively connected with the load connector 12 and is movable between an open position (FIG. 3) and a closed position (FIG. 4). When the movable contact 56 is engaged with the stationary contact 52, electrical continuity exists between the line and load connectors 8 and 12.

The expandable seal 60 is capable of expanding during movement of the movable contact 56 between the open and closed positions in order to maintain the integrity of the vacuum within the enclosed region 62. The container 44 is manufactured out of a substantially nonconductive material such as epoxy, ceramic, or other materials, and is formed with a plurality of fins to dissipate heat. Since the line and load connectors 8 and 12 are disposed at opposite ends of the container 44, substantially the only electrical connection or continuity that can exist between the line and load connectors 8 and 12 is that provided through the stationary and movable contacts 52 and 56 when the movable contact 56 is in the closed position.

Figure 5:
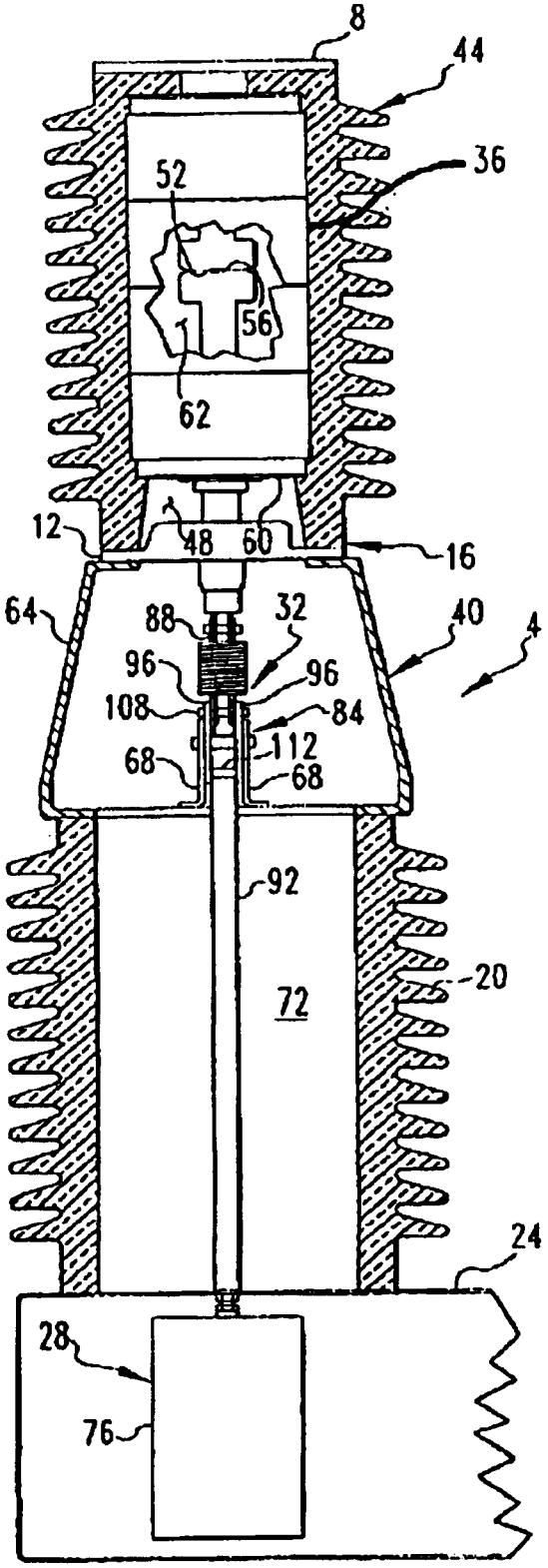
FIG. 5 is a right side elevational view, partially cut away, of the present invention.

The support 40 includes a housing 64 and a pair of fins 68 (FIG. 5). The fins 68 are oriented substantially parallel and spaced apart from one another for purposes to be set forth more fully below.

The insulation member 20 is an elongated nonconductive member formed of an epoxy, a ceramic, or other appropriate nonconductor. The insulation member 20 is of a hollow, generally cylindrical shape and includes an interior 72 as well as a plurality of fins formed on an exterior surface of the insulation member 20. The interruption device 16, and particularly the housing 64, is mounted to the insulation member 20.

The driving system 28 includes a drive unit 76 and a return spring 80. The drive unit 76 is mounted within the base 24 and can be any of a wide variety of mechanical devices suited to rapidly provide a sufficient level of force at a sufficient speed to operate the interruption device 16 in an appropriate fashion. The drive unit 76 may be of a variety of different configurations, and may be, for instance, a motor, a solenoid, a permanent magnet linear actuator, or other appropriate device.

The linkage mechanism 32 includes a crank 84, a first link 88, and a second link 92. The crank 84 includes a pair of parallel and spaced apart crank plates 96 (FIGS. 5 and 6) that are each formed with a first elongated slot 100 (FIGS. 3, 4, and 6) and a second elongated slot 104 at opposite ends thereof. As can be understood from FIGS. 3–6, the crank 84 is pivotably mounted to and disposed between the fins 68 of the support 40, whereby the fins 68 straddle the crank plates 96. More specifically, the crank plates 96 pivot about an axis that is substantially perpendicular to the fins 68 and is substantially perpendicular to the orientation of both the first and second links 88 and 92. The first and second elongated slots 100 and 104 of each crank plate 96 are oriented generally parallel with one another and are disposed in opposite directions from the axis about which the crank plate 96 pivots.

The first link 88 is mounted to the first elongated slots 100 and extends between the crank 84 and the movable contact 56. The first link 88 extends slidably through an appropriately configured opening formed in the load connector 12. The second link 92 is mounted to the second elongated slots 104 and extends between the crank 84 and the drive unit 76. The first and second links 88 and 92 are oriented generally parallel with one another and extend in generally opposite directions away from the crank 84. The second link 92 is manufactured of a nonconductive material such as an epoxy, and may additionally be fiber filament wound for strength.

It can be seen that the second link 92 extends through the interior 72 of the insulation member 20 and extends along a substantial portion of the insulation member 20. It is known that the insulation member 20 is elongated in order to electrically insulate the base 24 within which the drive unit 76 is mounted from the housing 64 of the interruption device 16.

The second link 92 is at least as long as the first link 88 and depicted in the accompanying figures as being longer than the first link 88. The second link 92 may be several times longer than the first link 88 depending upon the specific needs of the particular application.

As is best shown in FIG. 5, the first link 88 includes a first pin 108 that is slidably disposed in the first elongated slots 100. Similarly, the second link 92 includes a second pin 112 that is slidably disposed in the second elongated slots 104.

It thus can be seen that the crank 84 transmits mechanical motion between the drive unit 76 and the movable contact 56. More specifically, mechanical motion generated by the drive unit 76 is transmitted through the second link 92 to the crank 84, with the crank 84 then transferring the motion to the first link 88 and thus to the movable contact 56. It thus can be seen that the crank 84 is operationally interposed between the first and second links 88 and 92 and additionally transforms tensile forces from the second link 92 into compressive forces applied to the first link 88 and vice versa.

In order to move the movable contact 56 from the open position to the closed position, the drive unit 76 applies a tensile force to the second link 92 which is transmitted to the crank 84. The crank 84 transforms the tensile force into a compressive force that is applied to the first link 88 and thus to the movable contact 56. By applying a tensile force to the second link 92 and employing the crank 84 to apply the necessary compressive force to the first link 88 and to the movable contact 56, the second link 92 advantageously does not bow or buckle, and rather at most experiences only a limited elastic longitudinal deformation. It is particularly noted that the aforesaid elastic longitudinal deformation which results from tension loading of the second link 92 is significantly less that the longitudinal deformation due to bowing or buckling of the second link 92 that would result from the application of a compressive force of an equivalent magnitude. The movable contact 56 thus can be reliably moved a fixed known distance by the drive unit 76 without bowing of the second link 92, which advantageously resists rupturing of the expandable seal 60 and pitting or other destruction of the stationary and movable contacts 52 and 56, as well as more rapidly moves the movable contact 56 between the open and closed positions.

The return spring 80 is depicted in the accompanying figures as extending between the second pin 112 and a tang 116 extending from a portion of the housing 64. The return spring 80 advantageously facilitates moving the movable contact 56 from the closed position to the open position, and in this regard biases the movable contact 56 toward the open position.

Figure 6:
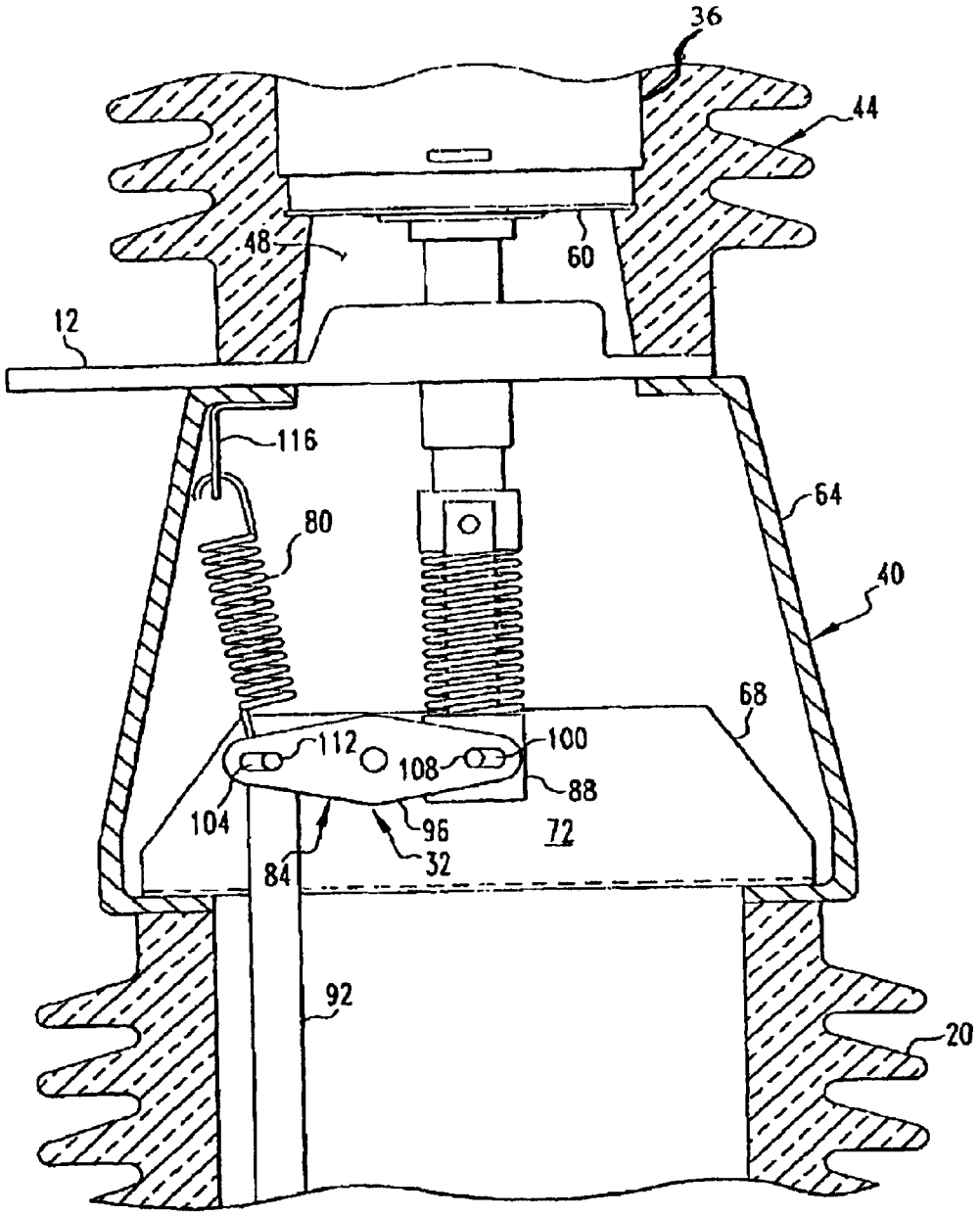
FIG. 6 is an enlarged front elevational view of the invention, partially cut away, and with the contacts being midway between the fully opened and fully closed conditions of FIGS. 3 and 4, respectively.

As is best seen in FIG. 6, the first and second elongated slots 100 and 104 permit the first and second pins 108 and 112 to slide therein during pivoting of the crank 84 between the open and closed positions, with the result that the first and second links 88 and 92 are permitted to travel substantially longitudinally without being pivoted. The avoidance of pivoting of the first and second links 88 and 92 further resists the potential for the expandable seal 60 to rupture and avoids undesirable stresses on the drive unit 76.

Accordingly, the improved electrical interrupter apparatus 4 employs a pull-to-close linkage mechanism 32 which provides for substantially precise movements of the movable contact 56 between the open and closed positions. It also provides for more rapid and reliable connections between the stationary and movable contacts 52 and 56 because it substantially eliminates the slack that would exist in the second link 92 if the second link 92 were bowed with the interruption device 16 in the closed position. In this regard, it can be understood that the second link 92 is in tension when the movable contact 56 is in the closed position, and that the first link 88 is correspondingly in compression.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical interrupter apparatus comprising:

an interruption device including an interior and having an enclosed region within at least a portion of the interior;

a stationary contact disposed within the enclosed region;

a movable contact disposed within the enclosed region;

the movable contact being movable between a closed position and an open position, the movable contact being engaged with the stationary contact in the closed position, the movable contact being spaced from the stationary contact in the open position;

a first link operatively connected with the movable contact;

a second link;

a crank pivotably mounted to the interruption device, the first and second links each being pivotably mounted to the crank;

a driving system including a drive unit;

the drive unit being operatively connected with the second link, the drive unit being structured to rapidly separate the movable and stationary contacts; and the second link being in a state of tension when the movable contact is in the closed position.

2. The electrical interrupter apparatus as set forth in claim 1, in which the driving system includes a return spring that biases the movable contact to the open position.

3. The electrical interrupter apparatus as set forth in claim 1, in which the first link is in a state of compression when the movable contact is in the closed position.

4. The electrical interrupter apparatus as set forth in claim 1, in which the interruption device includes a vacuum bottle and a support;

the vacuum bottle being mounted to the support;

the enclosed region being disposed within the vacuum bottle;

the crank being pivotably mounted to the support.

5. The electrical interrupter apparatus as set forth in claim 4, in which the driving system includes a return spring that biases the movable contact to the open position;

the return spring extending generally between the crank and the support.

6. The electrical interrupter apparatus as set forth in claim 1, in which the enclosed region includes a region of reduced pressure therein.

7. An electrical interrupter apparatus comprising:

an interruption device including an interior and having an enclosed region within at least a portion of the interior;

a stationary contact disposed within the enclosed region;

a movable contact disposed within the enclosed region;

the movable contact being movable between a closed position and an open position, the movable contact being engaged with the stationary contact in the closed position, the movable contact being spaced from the stationary contact in the open position;

a first link operatively connected with the movable contact;

a second link;

a crank operatively interposed between the first and second links;

a driving system including a drive unit;

the drive unit being operatively connected with the second link, the drive unit being structured to rapidly separate the movable and stationary contacts;

the first link being in a state of compression when the movable contact is in the closed position;

the second link being in a state of tension when the movable contact is in the closed position;

the first and second links being oriented generally parallel with one another.

8. The electrical interrupter apparatus as set forth in claim 7, in which the first and second links are mounted on the crank;

the first and second links extending in generally opposite directions away from the crank.

9. The electrical interrupter apparatus as set forth in claim 8, in which the interruption device includes a vacuum bottle and a support;

the vacuum bottle being mounted to the support;

the enclosed region being disposed within the vacuum bottle;

the crank being pivotable mounted to the support.

10. The electrical interrupter apparatus as set forth in claim 9, in which the crank is pivotable about an axis that is oriented substantially perpendicular to the longitudinal extent of the first and second links.

11. An electrical interrupter apparatus comprising:

an interruption device including an interior and having an enclosed region within at least a portion of the interior;

a stationary contact disposed within the enclosed region;

a movable contact disposed within the enclosed region;

the movable contact being movable between a closed position and an open position, the movable contact being engaged with the stationary contact in the closed position, the movable contact being spaced from the stationary contact in the open position;

a first link operatively connected with the movable contact;

a second link;

a crank operatively interposed between the first and second links;

a driving system including a drive unit;

the drive unit being operatively connected with the second link, the drive unit being structured to rapidly separate the movable and stationary contacts;

one of the first and second links being longer than the other of the first and second links, the one of the first and second links being in a state of tension when the movable contact is in the closed position; and in which the first link is in a state of compression when the movable contact is in the closed position.

12. An electrical interrupter apparatus comprising:

an interruption device including an interior and having an enclosed region within at least a portion of the interior;

a stationary contact disposed within the enclosed region;

a movable contact disposed within the enclosed region;

the movable contact being movable between a closed position and an open position, the movable contact being engaged with the stationary contact in the closed position, the movable contact being spaced from the stationary contact in the open position;

a first link operatively connected with the movable contact;

a second link;

a crank operatively interposed between the first and second links;

a driving system including a drive unit;

the drive unit being operatively connected with the second link, the drive unit being structured to rapidly separate the movable and stationary contacts;

one of the first and second links being longer than the other of the first and second links, the one of the first and second links being in a state of tension when the movable contact is in the closed position;

in which the interruption device includes a support;

the crank being pivotably mounted to the support;

in which the crank includes a first end and a second end opposite one another;

the first link being mounted to the first end;

the second link being mounted to the second end; and in which the crank includes a first elongated slot at the first end and a second elongated slot at the second end, the first link being mounted in the first elongated slot, the second link being mounted in the second elongated slot.

13. An electrical interrupter apparatus comprising:

an interruption device including an interior and having an enclosed region within at least a portion of the interior;

a stationary contact disposed within the enclosed region;

a movable contact disposed within the enclosed region;

the movable contact being movable between a closed position and an open position, the movable contact being engaged with the stationary contact in the closed position, the movable contact being spaced from the stationary contact in the open position;

a first link operatively connected with the movable contact;

a second link;

a crank pivotably mounted to the interruption device, the first and second links each being pivotably mounted to the crank;

a driving system including a drive unit;

the drive unit being operatively connected with the second link, the drive unit being structured to rapidly separate the movable and stationary contacts;

the second link being in a state of tension when the movable contact is in the closed position; and in which the crank includes a pair of elongated slots at opposite ends thereof, one of the first and second links being mounted in one of the slots, the other of the first and second links being mounted in the other of the slots.

14. An electrical interrupter apparatus comprising:

an interruption device including an interior and having an enclosed region within at least a portion of the interior;

a stationary contact disposed within the enclosed region;

a movable contact disposed within the enclosed region;

the movable contact being movable between a closed position and an open position, the movable contact being engaged with the stationary contact in the closed position, the movable contact being spaced from the stationary contact in the open position;

a first link operatively connected with the movable contact;

a second link;

a crank operatively interposed between the first and second links;

a driving system including a drive unit;

the drive unit being operatively connected with the second link, the drive unit being structured to rapidly separate the movable and stationary contacts;

the first link being in a slate of compression when the movable contact is in the closed position;

the second link being in a state of tension when the movable contact is in the closed position;

the first and second links being oriented generally parallel with one another;

in which the first and second links are mounted on the crank;

the first and second links extending in generally opposite directions away from the crank;

in which the interruption device includes a vacuum bottle and a support;

the vacuum bottle being mounted to the support;

the enclosed region being disposed within the vacuum bottle;

the crank being pivotable mounted to the support;

in which the crank is pivotable about an axis that is oriented substantially perpendicular to the longitudinal extent of the first and second links;

in which the support includes a pair or parallel and spaced apart fins;

the crank including a pair of crank plates;

the crank plates being pivotably mounted to the fins whereby the fins straddle the crank plates;

each crank plate including a pair of elongated slots spaced apart from one another in generally opposite directions from the axis about which the crank plate rotates; and the elongated slots being oriented generally parallel with one another.

* * * * *